US007194876B1

(12) United States Patent
Pacheco et al.

(10) Patent No.: US 7,194,876 B1
(45) Date of Patent: Mar. 27, 2007

(54) MODIFIED LOCK PLUG

(75) Inventors: Gayle E. Pacheco, Covina, CA (US); Frank Glover, Covina, CA (US); Tom Gulley, Covina, CA (US)

(73) Assignee: Western Hardware Company, Covina, CA (US)

( * ) Notice: Subject to any disclaimer, the term of this patent is extended or adjusted under 35 U.S.C. 154(b) by 0 days.

(21) Appl. No.: 11/250,129

(22) Filed: Oct. 13, 2005

(51) Int. Cl.
*E05B 15/16* (2006.01)

(52) U.S. Cl. ..... 70/1.5; 70/375; 70/419; 70/422; 70/423; 70/492

(58) Field of Classification Search ..... 70/375, 70/422, 50, 410, 439, 440, 416–420, 453, 70/454, 1.5, 492, 495, 423–428, 455
See application file for complete search history.

(56) References Cited

U.S. PATENT DOCUMENTS

| | | | | | |
|---|---|---|---|---|---|
| 1,705,344 | A * | 3/1929 | Thompson | ..... | 70/375 |
| 1,705,364 | A * | 3/1929 | Heyer | ..... | 70/421 |
| 1,736,685 | A * | 11/1929 | Wilder | ..... | 70/375 |
| 2,666,318 | A * | 1/1954 | Welch | ..... | 70/50 |
| 4,056,955 | A * | 11/1977 | Glass | ..... | 70/422 |
| 4,074,547 | A * | 2/1978 | Seidewand | ..... | 70/1.5 |
| 4,074,548 | A * | 2/1978 | Milton | ..... | 70/1.5 |
| 4,231,244 | A * | 11/1980 | Krugener et al. | ..... | 70/422 |
| 4,301,668 | A * | 11/1981 | Renz | ..... | 70/422 |
| 4,424,694 | A * | 1/1984 | Mochida | ..... | 70/422 |
| 4,454,736 | A * | 6/1984 | Mochida | ..... | 70/422 |
| 4,671,090 | A * | 6/1987 | Masaki et al. | ..... | 70/455 |
| 4,685,317 | A * | 8/1987 | DeWalch | ..... | 70/440 |
| 5,467,624 | A * | 11/1995 | Myers | ..... | 70/455 |
| 5,611,225 | A * | 3/1997 | Resch et al. | ..... | 70/422 |
| 6,397,647 | B1 * | 6/2002 | Kuo | ..... | 70/423 |
| 2005/0217329 | A1 * | 10/2005 | Chang | ..... | 70/417 |

* cited by examiner

*Primary Examiner*—Lloyd A. Gall
(74) *Attorney, Agent, or Firm*—Maria Erlinda Co Sarno

(57) ABSTRACT

A lock plug comprising a top end having a key way etched out of a solid wall, the key way leading to an interior of the lock plug housing a locking mechanism; and, a break away wall bordering a cavity carved out from the solid wall on a side of the key way, the break away wall forming a side of the key way. The locking mechanism in a lock plug usually employs the wafer technology and in this case, the interior of the lock plug includes a wafer cavity having wafers designed according to a particular key code.

12 Claims, 5 Drawing Sheets

MODIFIED LOCK PLUG

This invention relates to a modified lock plug having a break away wall for providing a deterrent in the use of an object other than the right key for turning a lock body out of its locking position.

BACKGROUND

A lock plug is usually inserted within or enveloped by a lock plug sleeve as a component of a lock body. Current lock plugs use the wafer technology. The wafers are inserted into one or several wafer access ports of a wafer cavity. The wafer cavity has a key guide number corresponding to a particular key code. The wafers vary in design according to a key code such that only a certain key with a bit corresponding to the particular key code can insert through the key hole into the wafer cavity housing the wafers and move the wafers into a locked or unlocked position. In a locked position, the key moves the wafers upwards such that the top surfaces of the wafers align and abut a corresponding groove on the inside surface of the lock plug sleeve. The key moves the wafers into or away from the grooves, which then allows the key to turn a rotator pin. The rotator pin rotates or moves translationally along a notch directly on a cam lock, or in some locks on a motion control sleeve, which directs the movement of a lock cam. The lock cam extends outwards from a lock cam holder in a locked position as the wafers abut the corresponding inside groove on the lock plug sleeve or recesses into the lock cam holder in an unlocked position as the wafers correspondingly recess into the wafer cavity. The lock body is usually protected from moisture, dust and other foreign matters by covering the key hole, key way and consequently the wafer cavity of the lock plug with a dust shutter or dust cover, hereinafter dust shutter. A scalp is usually crimped on top of the dust shutter laying on top of the lock plug. The walls surrounding the key hole or key cover are not designed to follow a certain key code for entry. These openings have no way of discriminating one key from another or stopping a thin edged device from entry into the key way. Further, the walls around the key hole or key cover also increase the support on a thin edged object when used to gain entry into the key hole because these walls and the walls of the key way provide a better grip for the thin edged object, thereby making it easier to forcefully turn the lock body to break the lock and gain access into a secured enclosure.

It is therefore an object of this invention to provide a lock plug that would reduce the ability to use a thin edged object or device to forcefully turn a lock body into an unlock position.

It is also an object of this invention to provide an improved lock plug that can be used with different utility locks without modifying the other components of the utility lock.

SUMMARY OF THE INVENTION

This invention relates to a lock plug comprising a top end having a key way etched out of a solid wall, the key way leading to an interior of the lock plug housing a locking mechanism; and, a break away wall bordering a cavity carved out from the solid wall on a side of the key way, the break away wall forming a side of the key way. The locking mechanism in a lock plug usually employs the wafer technology and in this case, the interior of the lock plug includes a wafer cavity having wafers designed according to a particular key code. The lock plug has a key hole placed on top of the key way. The carved out cavity bordered by the break away wall has a circular wall opposite the break away wall and extends horizontally at a distance equal or more than the length of the break away wall. The break away wall can have a break away relief point. Instead of incorporating a break away wall, the key way or the key hole can be modified to serve as a break away wall by carving out a similar cavity on its side. The break away wall has a height the same as the height of the solid wall from which the cavity has been carved out. The lock plug with a break away wall is adoptable to any lock having a lock plug as a component.

Other embodiments of the present invention will become readily apparent to those skilled in the art from the following detailed description, wherein it shows and describes only certain embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

Aspects of the present invention are illustrated by way of example, and not by way of limitation, in the accompanying drawings, wherein.

DETAILED DESCRIPTION OF THE INVENTION

The detailed description represented herein is not intended to represent the only way or the only embodiment in which the claimed invention may be practiced. The description herein is provided merely as an example or examples or illustrations of the claimed invention and should not be construed as the only way or as preferred or advantageous over other embodiments or means of practicing the invention. Any means of providing a break away wall bordering a cavity on a key way of a lock plug or modifying a key way or a key hole into a break away wall is within the scope of this invention. The detailed description includes specific details to provide a thorough understanding of the claimed invention and it is apparent to those skilled in the art that the claimed invention may be practiced without these specific details. In some instances, well known structures and devices are shown in block diagrams or drawn with broken lines in order to either avoid obscuring the main concepts of the invention or to show the relationship of one part to the other.

Figure 1:
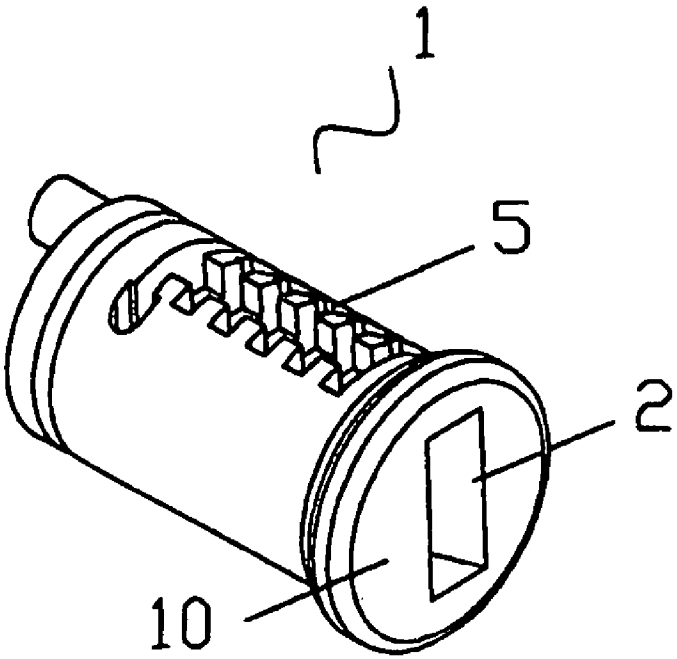
PRIOR ART FIG. 1
FIG. 1 shows a perspective view of a prior art lock plug showing the key way without a break away wall.
Figure 1A:
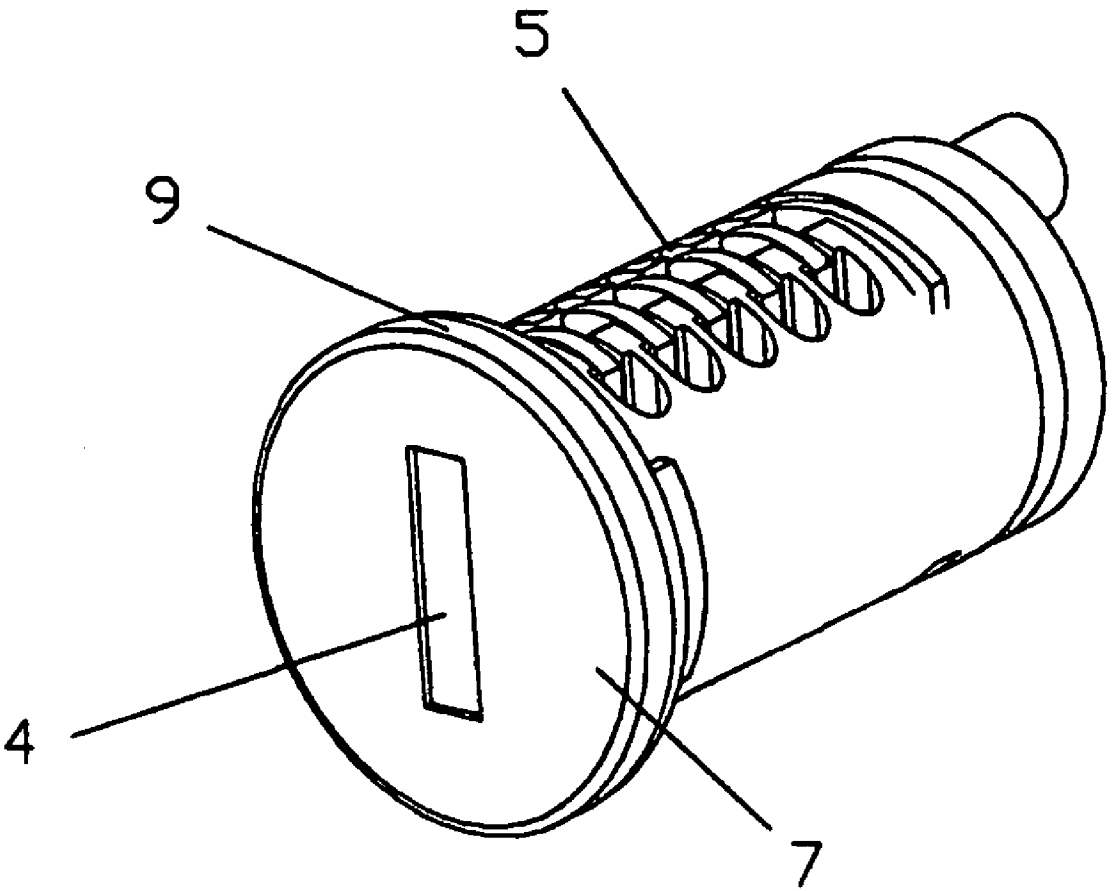
PRIOR ART FIG. 1A
FIG. 1A is a perspective view of a lock plug of FIG. 1 with a scalp having an exposed key hole crimped on the top of a lock plug.
Figure 2:
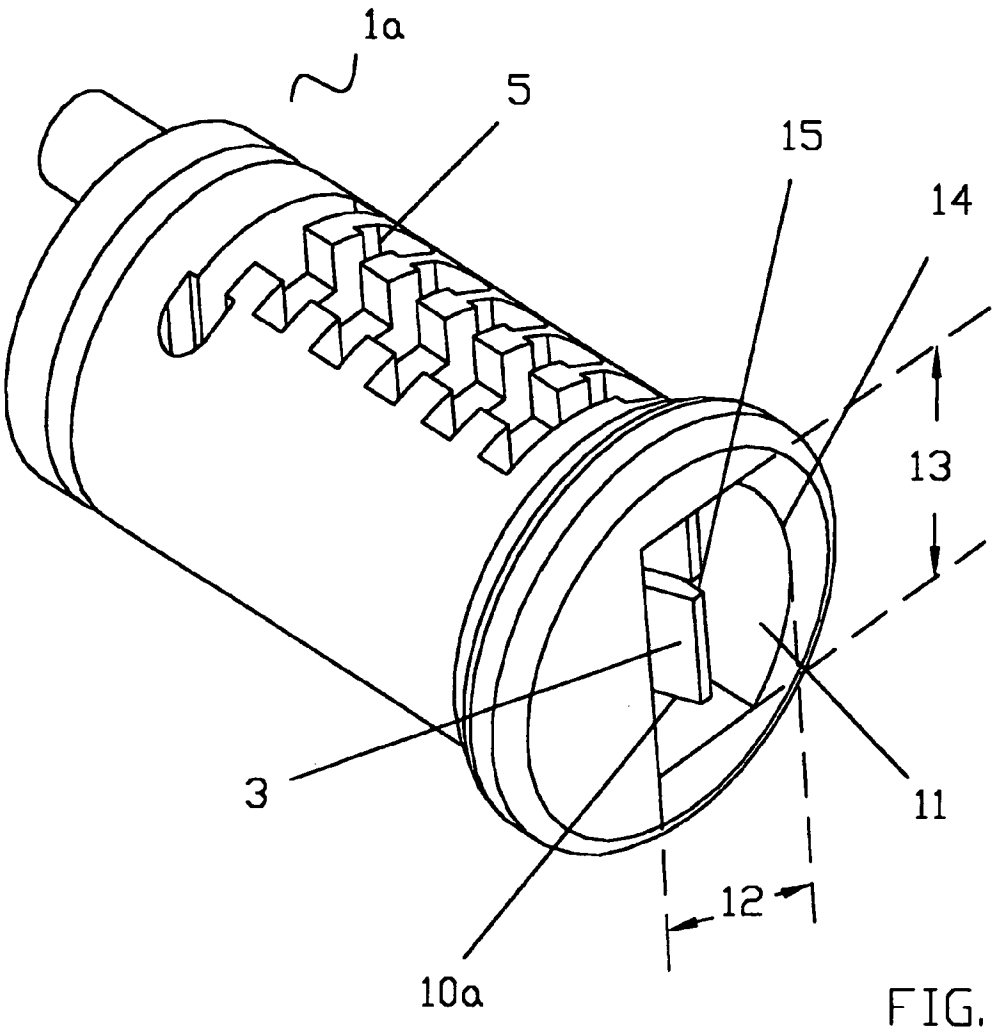
FIG. 2 is a perspective view of a lock plug showing the key way with a break away wall.
Figure 2A:
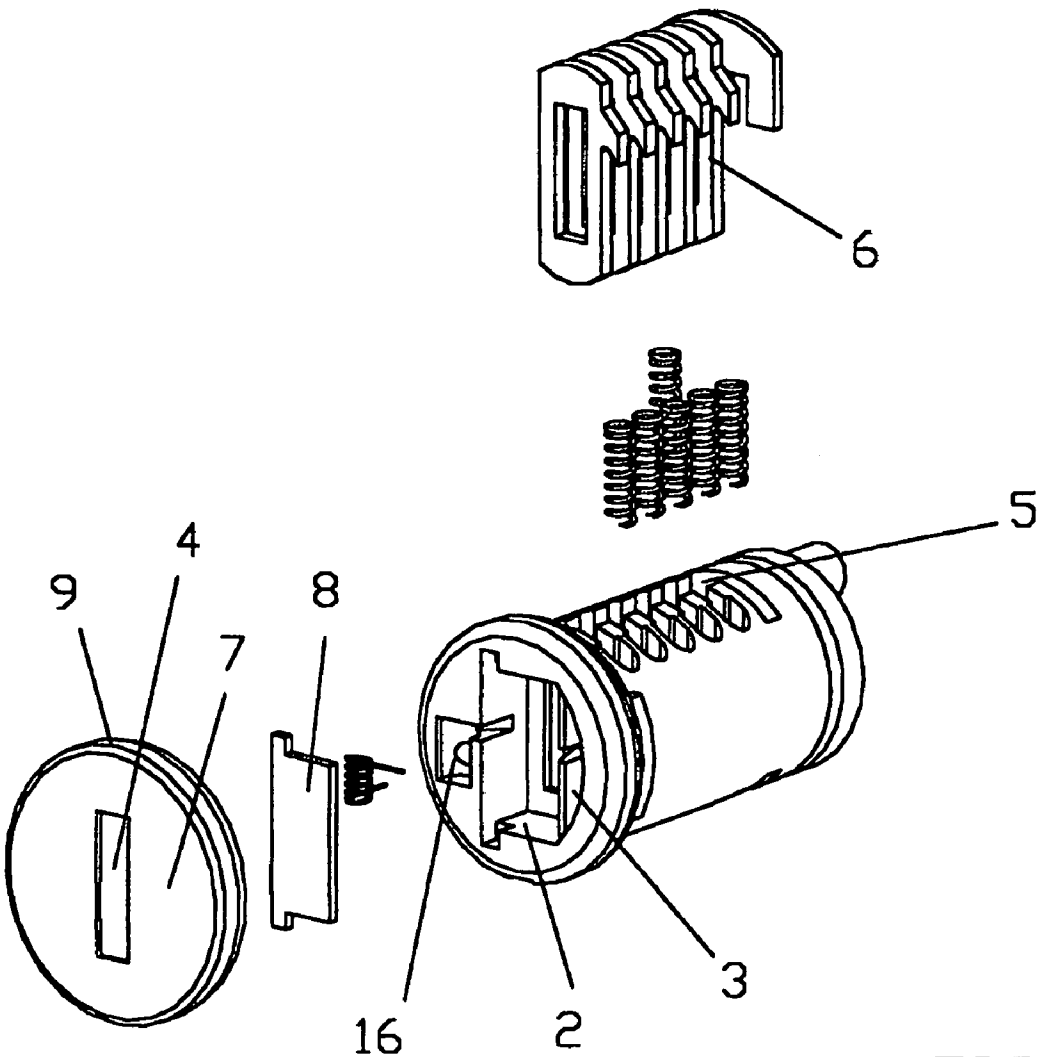
FIG. 2A is an exploded view of the components of the lock plug including a dust shutter and a key cover and FIG. 2B is a perspective view of the lock plug of FIG. 2A showing the lock plug at a different angle.
Figure 2B:
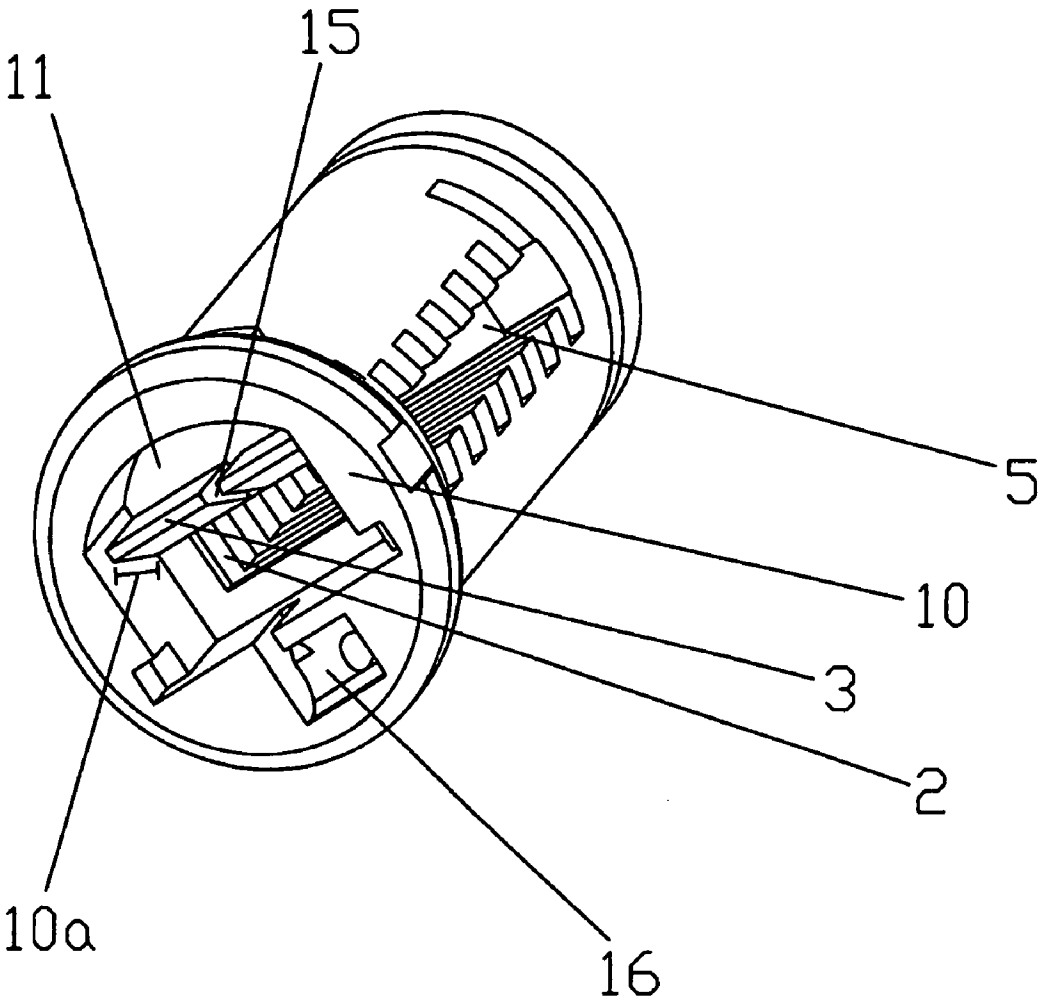

The modified lock plug does not alter the wafer technology applied to a conventional lock plug, including, the insertion of a spring into the wafer housing or wafer cavity, the design and number of wafers in a lock plug, the number and location of a rotator pin or protrusion that coordinates with the movement of a lock cam in a locked or unlocked position and the method of engagement of the lock plug with a lock cam or a lock base. This invention proposes a change in the physical design of the key way in a lock plug. FIG. 1 shows a prior art lock plug 1 having a key way 2 without a break away wall 3. A conventional lock plug typically has the key way 2 on a top end of the lock plug immediately behind a key hole 4 as shown in FIG. 1A. The key way is akin to a corridor that a key travels into before entering the wafer cavity 5 of the lock plug. The entry to the key way is wider than the entry into the wafer cavity. To clarify, from the user end, the key hole 4 is proximal to the user and is before the key way 2 which directly leads into the wafer cavity. The wafer cavity is not an empty space but houses the wafers 6 therein. FIG. 2 shows the modified lock plug 1*a* with the break away wall 3. The incorporation of a cavity bordered by a break away wall 3 into the key way 2 is core to this invention. FIGS. 2A and 2B show the break away wall with the key way and openings 16 used for attaching a dust shutter 7. The key way 2 on the lock plug is usually covered with the dust shutter 7 having a swinging or slidable cover 8 for the key hole 4 leading to the key way 2. As shown, the swinging or slidable cover 8 of the dust shutter 7 attaches on one side of the key way 2 which is superimposed by the flat dust shutter 7 having a slit for the key hole. The dust shutter and the slidable or swinging cover 8 therefore conceals the key way 2 behind the key hole 4. The dust shutter 7 when incorporated, is permanently attached on the top end of the lock plug usually by crimping a scalp 9 around the dust shutter 7 on the top end of the lock plug. The scalp 9 and the dust shutter 7 may also be die cast in one piece.

With the placement of a dust shutter 7 on top of a current lock plug, additional depth is created on the key hole 4 leading to the key way 2. Consequently, more surface is provided for a thin edged object or device such as a screw driver and the like to penetrate the key hole at a sufficient distance inside the key way and get enough leverage or control to forcefully turn the lock plug into an unlock position. The main factor that allows this is the type of material from which a lock plug is made. Lock plugs are usually made of a non-malleable, non-resilient hard metal or a hard rigid plastic. The solid metal wall 10 bordering the key way of the lock plug is also made of the same material as the lock plug. As shown in FIG. 1, the key way 2 is etched out of the solid wall 10. This solid wall provides the hold on the thin edged device to enable it to turn the lock plug simultaneously with the turn of the thin edged device. This is prevented by modifying the lock plug. The modified lock plug 1*a* as shown in FIG. 2, carves out a portion of the solid metal wall 10 on a side of the key way 2 to form a cavity 11 but leaving behind a strip of the original solid wall 10 bordering the key way, now identified as break away wall 3. Because the break away wall was carved out from the solid wall, it has the same height 10*a* as the solid wall 10. The break away wall provides a side of the key way or key guide as shown in FIGS. 2, 2A and 2B. FIG. 2 shows the modified lock plug without a shutter. In this type of lock plug, looking from the top, the key way is between the uncarved solid wall 10 and the break away wall 3. FIGS. 2A and 2B show a modified lock plug that accommodates a shutter. When a shutter is installed, an opening 16 is etched out at the side of the solid wall 10 opposite cavity 11 where the swinging or slidable cover 8 of the shutter is installed. FIG. 2B is the same modified lock plug shown in FIG. 2A but angled differently to show more clearly the position of the cavity 11 in relation to the key way, break away wall and the opening 16 for the shutter. For locks with the break away wall, a thin edged device can penetrate into the key way and/or the key hole but when the device is used to turn the lock plug, the break away wall 3 will fall apart, resulting in the removal of the barrier or border provided by the break away wall on the cavity 11. Once the break away wall falls apart, the required leverage or control to turn the lock plug is lost. In this instance, the thin edged device will just turn around the key way without turning the lock plug. The cavity should extend horizontally at a distance 12 equal or more than the length 13 of the break away wall 3 and is recommended to have a circular wall 14 opposite the break away wall as shown in FIG. 2 to accommodate the turning of the thin edged device after the break away wall has fallen apart. The break away wall 3 can be solid or it can have one or a number of break away relief points 15. The number of break away relief points depend upon the resulting strength desired for the break away wall. The more break away relief points, the easier it is to tear apart the break away wall. The proposed break away wall 3 can be adopted to any existing lock plug design and to any lock having a lock plug as a component. Example of existing locks containing a lock plug are cylinder locks and barrel style locks.

The modified lock plug 1*a* can be easily manufactured by die casting on a mold having the desired cavity and the desired break away wall with the desired number of break away relief points 15. Other means of manufacturing the modified lock plug are possible. The modified lock plug and consequently, the break away wall when manufactured by die casting are made of metal or hard plastic material. If the plug has an opening 16 for the dust shutter connectors placed on top of the lock plug, the cavity is carved out at the side opposite the opening 16 as shown in FIG. 2A. It is also possible to cast a modified lock plug where the key hole is also the key way as well as the break away wall so long as a cavity is carved out at the side of the key hole. In this case, since there are no break away relief points 15 on the key hole which is also serving as the break away wall, more force is required to break the key hole. If one chooses to modify the lock plug in this manner, the thickness of the wall bordering the key hole and consequently the key way should be just sufficient to provide the key guide for the key and still have the strength to allow in and out passage of the key as well as the repeated turning of the key on the key hole without these motions breaking the key hole serving as the break away wall.

While the embodiments of the present invention have been described, it should be understood that various changes, adaptations, and modifications may be made therein without departing from the spirit of the invention and the scope of the claims.

We claim:

1. A lock plug, comprising:

a top end having a key way etched out of a solid wall, the key way leading to an interior of the lock plug housing a locking mechanism; and, a break away wall bordering a cavity carved out from the solid wall on a side of the key way, the break away wall forming a side of the key way.

2. The lock plug of claim 1 further comprising a key hole placed on top of the key way.

3. The lock plug of claim 1 wherein the carved out cavity extends horizontally at a distance equal or more than the length of the break away wall.

4. The lock plug of claim 1 wherein the carved out cavity has a circular wall opposite the break away wall.

5. The lock plug of claim 1 wherein the top end has the carved out cavity on one side and an opening for a dust shutter connection on another side.

6. The lock plug of claim 1 further comprising a break away relief point on the break away wall.

7. The lock plug of claim 1 wherein the break away wall is a wall on the key way.

8. The lock plug of claim 1 wherein the break away wall is a wall on the key hole when the key hole is the same as the key way.

9. The lock plug of claim 1 wherein the break away wall has a height the same as the height of the solid wall.

10. The lock plug of claim 1 wherein the lock plug with a break away wall is adoptable to any lock having a lock plug as a component.

11. A lock plug, comprising:

a top end having a key way etched out of a solid wall, the key way leading to an interior of the lock plug housing a locking mechanism;

a break away wall bordering a cavity carved out from the solid wall on a side of the key way, the break away wall forming a side of the key way; and, a break away relief point on the break away wall.

12. A lock plug employing a wafer technology, comprising:

a top end having a key way etched out of a solid wall, the key way leading to a wafer cavity;

a wafer inside the wafer cavity; and, a break away wall bordering a cavity carved out from the solid wall on a side of the key way, the break away wall forming a side of the key way.

* * * * *